US005189245A

United States Patent [19]

Bundy

[11] Patent Number: 5,189,245

[45] Date of Patent: Feb. 23, 1993

[54] THERMALLY AND MECHANICALLY STABLE MUZZLE REFERENCE SYSTEM COLLIMATOR ASSEMBLY

[75] Inventor: Mark L. Bundy, Bellcamp, Md.

[73] Assignee: The United States of America as represented by the Secretary of the Army, Washington, D.C.

[21] Appl. No.: 816,005

[22] Filed: Jan. 2, 1992

[51] Int. Cl.[5] ..... F41G 1/46; F41G 1/54

[52] U.S. Cl. ..... 89/14.1; 42/76.02; 359/820; 89/41.17

[58] Field of Search ..... 89/14.1, 14.05, 16, 89/41.17, 41.06, 41.19; 42/76.02; 359/820

[56] References Cited

U.S. PATENT DOCUMENTS

| | | | |
|---|---|---|---|
| 3,484,718 | 12/1969 | Foster | 359/820 |
| 4,704,010 | 11/1987 | Stana et al. | 359/820 |
| 4,854,671 | 8/1989 | Hanke et al. | 359/820 |
| 4,956,956 | 9/1990 | Maier et al. | 52/584 |

FOREIGN PATENT DOCUMENTS

| | | | |
|---|---|---|---|
| 461138 | 11/1949 | Canada | 359/820 |
| 198964 | 10/1986 | European Pat. Off. | 89/41.17 |

*Primary Examiner*—Stephen M. Johnson
*Attorney, Agent, or Firm*—Saul Elbaum; Freda L. Krosnick

[57] ABSTRACT

A thermally and mechanically stable muzzle reference system collimator assembly. The assembly comprises a muzzle reference system collimator and an adaptor plate to adapt the muzzle reference system collimator to the muzzle of a gun. The muzzle reference system collimator and adaptor plate are made up of materials having a low coefficient of thermal expansion. The adaptor plate is bonded to the gun barrel through materials which are capable of absorbing, rather than transmitting, the shock of firing to the muzzle reference system collimator and its fragile internal optical components.

5 Claims, 6 Drawing Sheets

THERMALLY AND MECHANICALLY STABLE MUZZLE REFERENCE SYSTEM COLLIMATOR ASSEMBLY

RIGHTS OF THE GOVERNMENT

The invention described herein may be manufactured, used and licensed by or for the U.S. Government without payment to us of any royalty thereon.

BACKGROUND OF THE INVENTION

The present invention deals with a thermally and mechanically stable muzzle reference system collimator (MRSC) assembly which consists of an MRSC and an MRSC-to-barrel adaptor (to affix the MRSC to a gun barrel). An MRSC is a device which is attached to the external surface of a gun barrel at the muzzle. The MRSC is used by the tank gunner to correct the firing aim for thermal distortion of the barrel without the gunner having to leave the tank, i.e., without the gunner having to insert a muzzle bore scope into the barrel to determine where the muzzle is pointing before firing.

The U.S. Army performance specifications for such a device can be found in the Material Needs Document for the M1 and M1A1 tank as follows:

> 6.2.3.12 Accuracy retention. Once boresight is established, it is essential that the weapons system retain the armament accuracy provided by a boresighting exercise. The banded requirement is to retain boresight within 0.15 mil elevation/depression and 0.15 mil azimuth deflection for 320–360 miles, 158–177 main gun rounds, and 51–58 hours of fire control use. Additionally, deviations from main gun muzzle-main gun sight alignment must be controlled so as to allow the MBT to attain its required hit probabilities at all times.

In other words, if an MRSC is used to retain accuracy (by determining where the muzzle of the gun is actually pointing), then the MRSC must agree with a muzzle bore scope to within 0.15 mil, in both elevation and azimuth (a mil is an angular unit of measure with 6400 mils in a complete circle), after the stated number of miles, rounds, and hours of operation.

The first MRSC, manufactured for the 105 mm M68 main gun on the M1 tank, was tested by the U.S. Army Combat Systems Test Activity in 1977. After several iterations, a design was reached which appeared to meet the specified tracking requirements, although not by a large margin. Further testing of the initial production MRSCs revealed occasion-to-occasion tracking failures that have not been eliminated by any subsequent design modifications to date. In spite of these chronic failures, M1 tank gun accuracy is generally considered better with, as opposed to without, the MRSC.

However, with the introduction in the early 1980's of the larger, 120 mm M256 gun barrel for the M1A1 tank (the up-graded version of the M1 tank), the susceptibility of the MRSC to failure increased. As discovered with the M1 MRSC, the M1A1 MRSC seemed to shift during the first few rounds of firing. Moreover, not only is mechanical stability a problem, but cracking of the MRSC optical components, breaking of welds and bolts, moisture retention, and damage to the tritium light source within the MRSC is also a problem on the M1A1 gun system. Various methods of attaching the MRSC to the M256 barrel were tried, unsuccessfully, to solve these problems. In fact, after ten years of research and development, no satisfactory solution has yet been found. Even though the M1A1 tank is fielded with an MRSC, the functional value of this device is more in doubt than it was on its predecessor—the M1 tank. To understand why the M1A1 MRSC is prone to failure, it is necessary to discuss its design features in more detail.

The MRSC assembly presently in use on the M1A1 tank gun is manufactured by General Dynamics Land Systems Division—see FIGS. 1–3. Since it is made of steel, said MRSC has a high coefficient of thermal expansion. It is fixedly attached—bolted—to the top side of the gun barrel, covering from approximately 10 cm to approximately 20 cm from the muzzle end. These design features are the source of numerous deficiencies affecting not only the tracking accuracy of the MRSC, but also the shooting accuracy of the gun itself. That is, the material of which the MRSC is made and the manner in which it is attached to the gun barrel create a one-sided heat sink on the top side of the barrel near the muzzle. As a result, the top of the barrel cools faster than the bottom, creating a bottom hotter-than-top, cross-barrel temperature difference when the gun is fired. Consequently, thermal expansion is greater on the bottom side than on the top side of the barrel, which causes the barrel to thermally distort/bend upwards in the vicinity of the MRSC, i.e., near the muzzle. Since the projectile tends to follow the pointing angle of the muzzle, the muzzle angle distortion tends to degrade the accuracy of the gun by redirecting the muzzle, and hence the projectile, away from its initial pre-firing aim point (especially during rapid-fire heating).

Moreover, while the MRSC is acting as a one-sided heat sink for the barrel, the barrel is acting as a one-sided heat source for the MRSC. As a result, the bottom side of the MRSC becomes hotter than the top, which thermally distorts the MRSC itself (due to uneven expansion of the steel MRSC housing). The distortion of the MRSC housing alters the projected image of the MRSC reticle in such a way that it gives the gunner a false indication of the actual muzzle pointing angle (including the change in the muzzle pointing angle induced by the one-sided heat flow into the MRSC).

In addition, even though the MRSC is rigidly bolted to the barrel, being made of steel, it is so massive that it is prone to displacement from its original (pre-firing) position due to large radial and axial accelerations that occur during firing. (The radial acceleration occurs when the high pressure gas behind the projectile passes under the MRSC, and the axial acceleration is caused by the barrel recoil).

Moreover, because of the rigid bolting mechanism, the internal optical components of the MRSC are susceptible to breakage as the MRSC reacts to the large acceleration loads imparted to it during firing.

These adverse effects (thermal distortion, position displacement, and optical component breakage) degrade the overall gun systems' performance and are believed to be responsible for the failure of the current M1A1 MRSC to meet the tracking requirements specified in the material need documents for the M1A1 tank.

The present invention overcomes the current deficiencies in the prior art MRSCs, and serves to satisfy a long overdue need for an improved MRSC assembly.

BRIEF SUMMARY OF THE INVENTION

The present invention is based on an MRSC assembly which is fabricated from relatively light-weight material with a low coefficient of thermal expansion. In addition, the new MRSC assembly will be elastically, rather than rigidly, attached to the gun muzzle using a silicone like material. Such an elastic affixing layer will also provide a low thermal conductivity barrier between the gun steel and the MRSC housing. The advantages of the new design (over prior art) are as follows.

Use of materials having a low coefficient of thermal expansion, such as carbon-carbon, for the MRSC assembly diminishes the thermal distortion of the MRSC due to one-sided heating thereof from the barrel. Moreover, the elastic affixing material, such as silicone, generally has a relatively low thermal conductivity (compared to steel), and thus tends to block one-sided heat flow from the barrel to the MRSC. This reduces the cause of both MRSC and muzzle angle distortion. And lastly, the elastic affixing material, will serve to absorb, rather than transmit, the shock of firing to the MRSC. This will insure that the MRSC returns to its pre-firing position after every round, and it will help to prevent the breakage of internal MRSC components.

The improvements within the scope of the present invention will permit the new MRSC assembly to accurately track the changes in the aiming angle of the muzzle to which it is elastically attached. Use of the invention herein avoids the inadequacies present in the prior art MRSCs.

Accordingly, it is the general objective of the present invention to provide a thermally and mechanically stable muzzle reference system collimator assembly.

It is an object of the present invention to provide an improved MRSC which will not undergo thermal distortion from unidirectional heat transfer to it during firing.

It is a further object of the present invention to provide an improved MRSC which will not undergo thermal distortion from undirectional heat transfer to it due to the elements—i.e., sun, rain or wind.

It is still further an object of the present invention to provide an MRSC assembly which is not susceptible to permanent displacement or breakage of its internal optical components resulting from the mechanical loads imparted to it during firing.

Still, a further object of the present invention is to provide an MRSC assembly which meets, for the first time, the muzzle tracking requirements specified in the material need document for the M1A1 main battle tank.

A further object of the invention is to provide an MRSC which will not act as a one-sided heat sink for the barrel and hence cause the muzzle angle to thermally distort upwards, likewise affecting the fall of shot, during firing.

The means to achieve these and other objectives of the present invention will be apparent from the following detailed description of the invention, drawings and the claims.

DETAILED DESCRIPTION OF THE INVENTION

The MRSC assembly of the present invention elicits superior qualities as compared to the MRSCs currently available and in use. It is made up of an MRSC and an MRSC-to-barrel adaptor plate. The MRSC assembly herein has improved properties due to the selection of materials from which the MRSC is constructed as well as the adaptor means in which it is affixed to the gun muzzle.

The MRSC is constructed from selected material having a low coefficient of thermal expansion. Materials meeting the criteria of the present invention are those whose coefficient of thermal expansion range (in magnitude) from one-tenth to one-fifth that of steel (the current MRSC material). Use of materials which fall within this select category minimizes muzzle tracking inaccuracies caused by the uneven heating and hence thermal expansion of the MRSC itself upon firing of the gun. Among the materials which may be used herein are carbon-carbon fiber matrix, such as the 3-D carbon-carbon product manufactured by Hercules, Aerospace Products Group, P.O. Box 98, Magna, Utah 84044, and materials having like properties.

The MRSC within the scope of the present invention is elastically, as opposed to rigidly, affixed to the barrel of a gun. This is accomplished through use of an MRSC-to-barrel adaptor plate which is also composed of materials having a low coefficient of thermal expansion. Materials suitable for use for the MRSC are equally suitable for the adaptor plate herein. The MRSC is bolted onto the adaptor plate and the adaptor plate is elastically bonded to the barrel. Use of an elastic means of attaching (adapting) the MRSC to the barrel serves to absorb the shock of firing the gun, rather than transmitting it into the MRSC. This reduces the likelihood of both shock induced misalignment of the MRSC and damage to the internal optical components within the MRSC. Materials which may be used to elastically affix the adaptor plate to the barrel are silicone and silicone adhesives, such as Dow Corning 3145 RTV adhesive/sealant manufactured by Dow Corning Corporation, Midland, MI 48640, and others having like properties. Silicone typically has a thermal conductivity which is several hundred times less than steel. Use of these types of materials to elastically affix the adaptor plate to the gun barrel will block the asymmetric flow of heat out of the barrel and into the MRSC. This will reduce both thermal distortion of the MRSC (due to asymmetric/one-sided heating) and thermal distortion of the barrel (due to asymmetric/one-sided cooling).

The combination of using materials having a low coefficient of thermal expansion for the MRSC and MRSC-to-barrel adaptor, and using materials which have a low thermal conductivity and high elasticity to bond the adaptor plate to the barrel will substantially reduce thermal distortion and mechanical movement of the MRSC, and thus improve its muzzle tracking performance during firing. In addition, preventing asymmetric/one-sided heat transfer from the barrel to the MRSC assembly will reduce thermal distortion of the barrel at the muzzle, and hence reduce the adverse effect such muzzle angle distortion has on gun accuracy, viz., on redirecting the flight path of the projectile as it exits the gun.

The present invention may be implemented into the current/fielded M256 tank gun barrel along with its accompanying thermal shroud. In order to make use of the present invention therein, the composite MRSC assembly within the scope of the present invention must be constructed in two parts—the MRSC and the MRSC-to-barrel adaptor (plate). Both parts are made from the same material. (On other gun systems, it may be possible to consolidate these two parts into a single piece). The adaptor is to be elastically bonded to the MRSC "up-stand," an elevated flat area near the muzzle of the barrel, which is machined out of the barrel and is therefore a contiguous part of the barrel (see FIG. 4). The adaptor shall have threaded holes available so that the MRSC may be bolted thereto and may be easily removed therefrom for maintenance, repair or replacement of the MRSC, the thermal shroud, or the bore evacuator. The composite (e.g. carbon-carbon) MRSC within the scope of the invention will be internally cast, or machined, to accept the same threaded tritium source and beam splitter unit as used in the current steel MRSC. Such an internal casting or machining will avoid the need of making any modifications to the existing and conventional tritium source and beam splitter unit. In addition, the MRSC within the scope herein will be cast, or machined, to accept the use of the same, conventional lens housing as currently used in the steel MRSC. Hence, the only modifications which are required to be made to the existing optical MRSC components, so as to make them compatible with the present invention, is to manufacture a reticle housing which is threaded so as to mate with complementary threads cast, or machined, into the composite MRSC herein. As set forth, the MRSC within the scope of the present invention is cast, or machined, so as to permit the use of already available, M1A1 MRSC optical components.

Other features of the present invention will be apparent from the following drawings and their description.

DETAILED DESCRIPTION OF THE DRAWINGS

The drawings will be further discussed in order to provide a better understanding and description of the present invention.

Figure 1:
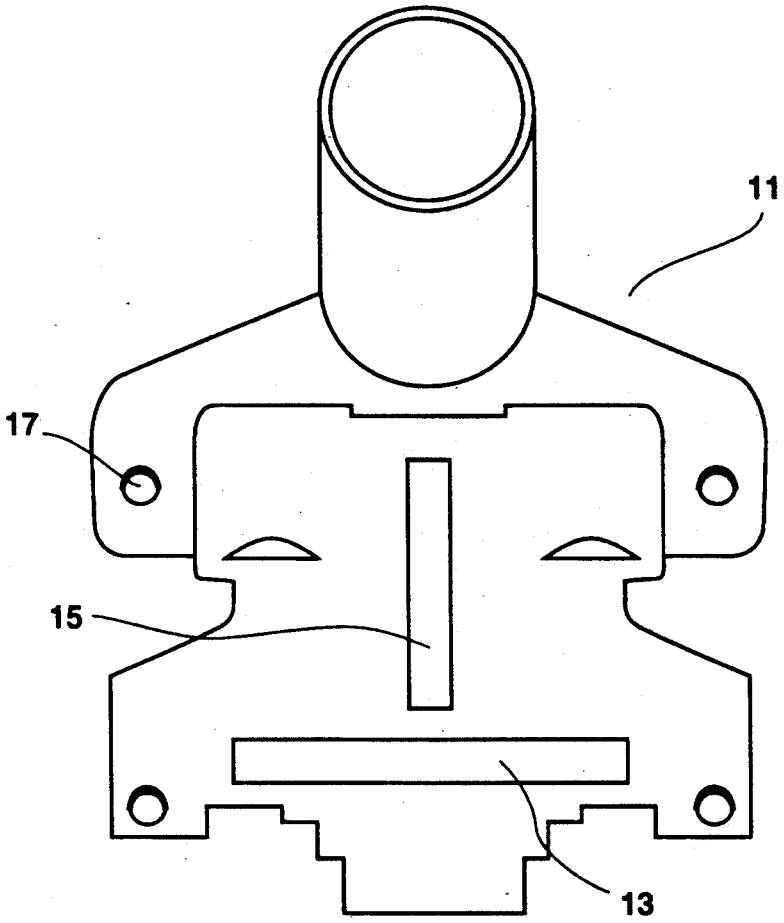
FIG. 1 is a schematic of the underside view of the MRSC currently used on the M1A1 tank gun.

FIG. 1 illustrates a schematic of the underside view of the MRSC 11 currently in use on the M1A1 tank gun. This MRSC, which is made of steel and is rigidly bolted to the top of the gun barrel (not shown), is manufactured by General Dynamics Land Systems Division, P.O. Box 2074, Warren, MI. This particular MRSC 11 is made from materials having a high coefficient of thermal expansion, which contributes to the adverse properties discussed above as to the prior art MRSCs. Moreover, the manner in which it is attached to the gun barrel does not permit the shock of the gun fire to be buffered. This makes the prior art MRSC susceptible to breakage of its internal optical components (also not shown). The MRSC 11 is equipped with holes 17 through which it can be bolted to the mounting up-stand which protrudes out of, and is part of, the gun barrel (not shown—see FIG. 2). Moreover, the MRSC is also provided with a male longitudinal protrusion 15 and a male transverse protrusion 13 which assists in the mounting of the MRSC 11 onto the mounting up-stand. Said protrusions 15 and 13 marry up with longitudinal slot 43 and transverse slot 45 (not shown in FIG. 1, but set forth in FIG. 2).

Figure 2:
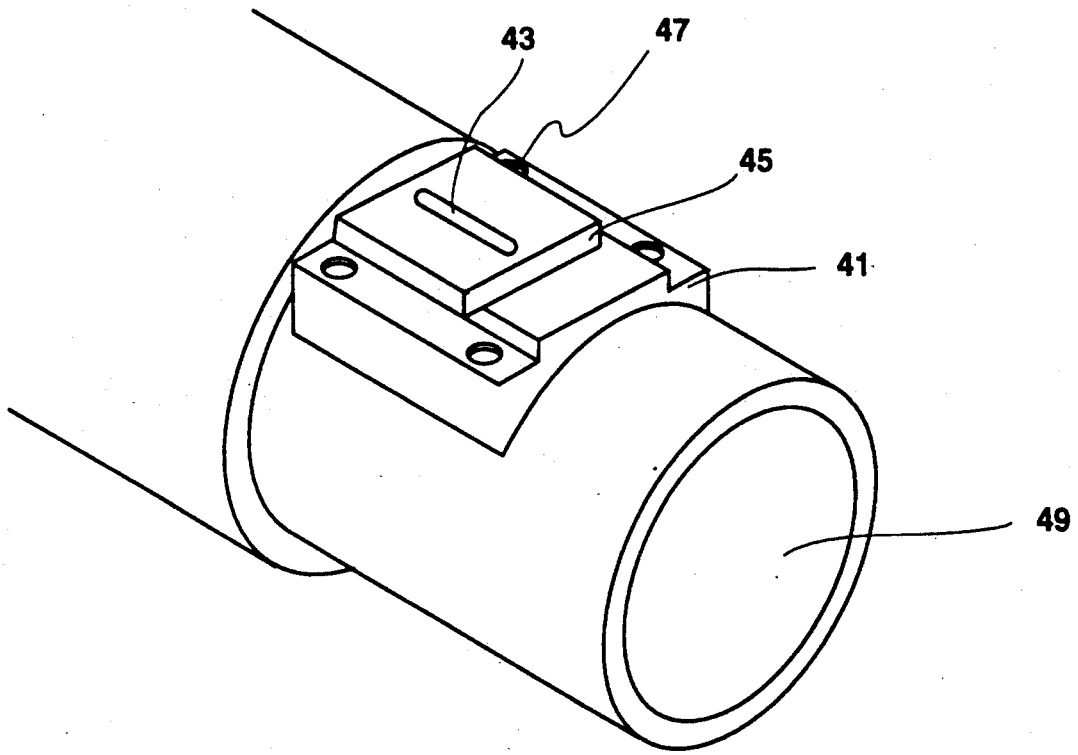
FIG. 2 is a schematic representation of the MRSC mounting up-stand, which is machined out of the gun barrel and is therefore a part of the gun barrel. It is used to mount the MRSC currently used on the M1A1 tank gun.

FIG. 2 illustrates the top view of a mounting up-stand 41 which is part of the M256, 120 mm, M1A1 main tank gun 49 manufactured at the U.S. Army Watervliet Arsenal, Watervliet, NY. Said up-stand is comprised of threaded holes 47 which match up to the holes 17 on the MRSC 11 (FIG. 1). Once longitudinal slot 43 and transverse slot 45 on up-stand 41 have been aligned to male longitudinal protrusion 15 and male transverse protrusion 13 on MRSC 11, bolts are run through holes 17 and threaded into holes 47 thereby securing MRSC 11 to the gun barrel up-stand 41 and hence the gun barrel 49.

Figure 3:
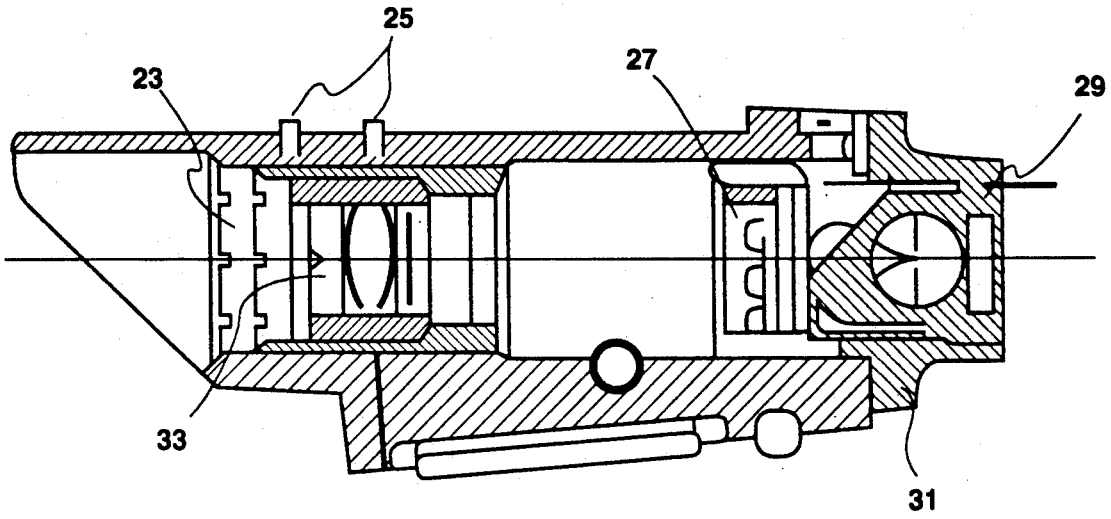
FIG. 3 is a schematic representation of the internal components of the MRSC currently used on the M1A1 tank gun.

FIG. 3 illustrates a schematic of the internal component parts of the prior art MRSC set forth in FIG. 1. Note that the conventional prior art MRSC comprises a reticle and tritium cell housing assembly 31; a tritium source and beam splitter cell 29; a metal reticle 27; a lens cell housing 33; a locking ring 23 and set screws 25 for locking lens cell housing 33 containing the conventional lenses in place.

The composite MRSC within the scope of the present invention, for example purposes only, may contain all of the internal component parts of the prior art MRSC set forth in FIG. 3—i.e., components 23, 25, 27, 29, 31 and 33. The differences between the MRSC illustrated in FIG. 3, as well as other prior art MRSCs, and the MRSC of the present invention is that the present invention employs materials having a low coefficient of thermal expansion, as opposed to steel. In addition the present invention MRSC is elastically attached to the top of the gun barrel, whereas the prior art MRSCs are fixedly attached thereto. And lastly, the MRSC of the present invention is thermally isolated from the barrel by using a low thermal conductivity elastomer/adhesive, whereas the prior art MRSCs were in direct metal-to-metal thermal contact with the barrel.

Figure 4:
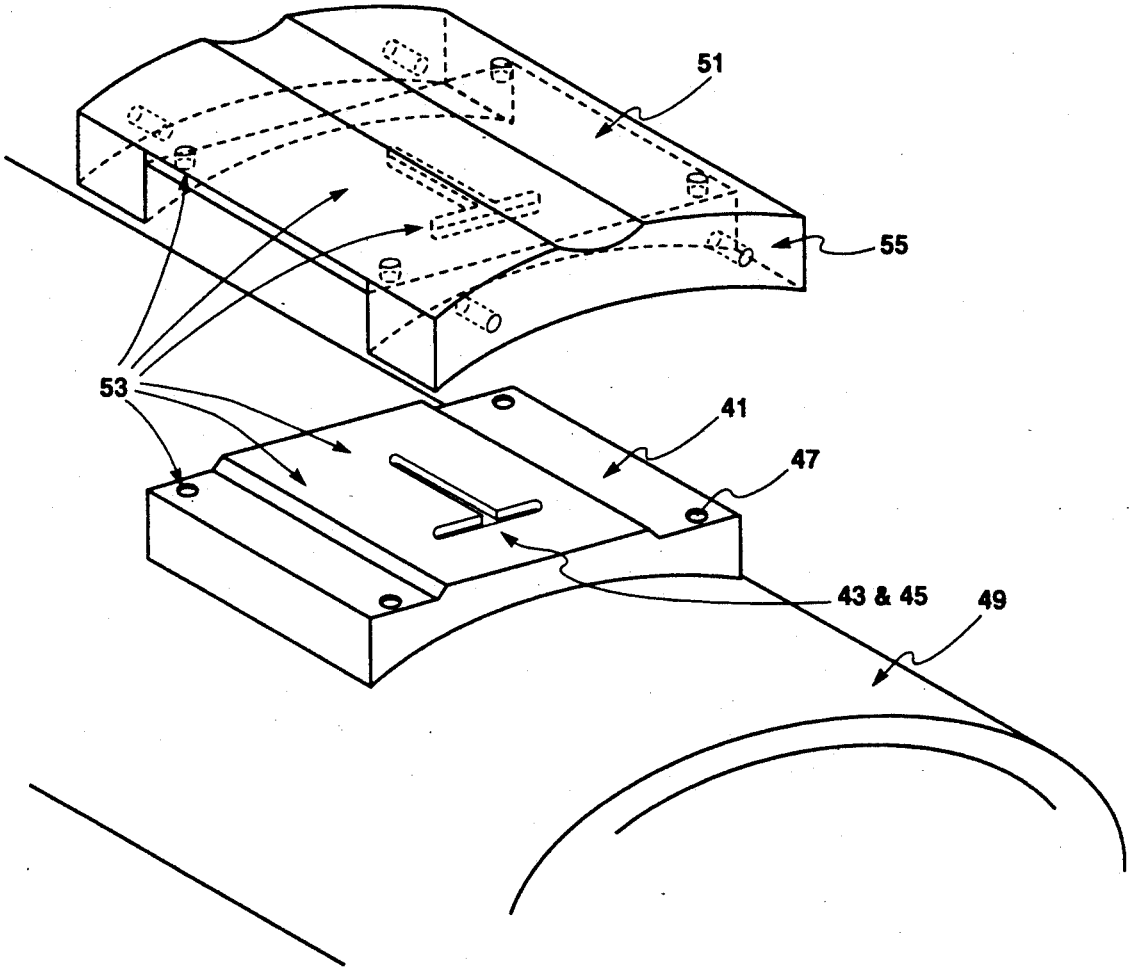
FIG. 4 is a schematic of the composite MRSC adaptor plate (part 1 of the 2 part MRSC assembly herein) to which the MRSC (part 2) is attached.

FIG. 4 illustrates a feature of the present invention, the composite adaptor plate 51 which is used to adapt the MRSC (not shown) of the present invention to the existing MRSC up-stand 41 already present on, for example, the M256 tank gun barrel 49. The existing MRSC up-stand 41 is machined as one piece out of the gun barrel 49. Said up-stand is equipped with keyways 43 and 45 (also referred to herein as longitudinal slots and transverse slots) which facilitate the mounting of the composite adaptor plate 51 thereto. It is the composite adaptor plate 51 which is bonded to the up-stand 41 with an elastomeric adhesive, such as silicone. The use of such an elastic interface will serve to absorb rather than transmit the shock to the MRSC due to the firing of the tank gun barrel 49. Said composite adaptor plate 51 and existing MRSC up-stand 41 have various complementary interfaces 53 to increase the surface area over which the elastomeric adhesive can be applied to facilitate their secure joining. The composite adaptor plate 51 is equipped with threaded holes 55 for attaching the MRSC (not shown) thereto. The MRSC is attached thereto using composite bolts—bolts which are machined from a block of the same composite material that the composite MRSC and adaptor plate are made from, e.g., carbon-carbon, and the like.

Figure 5:
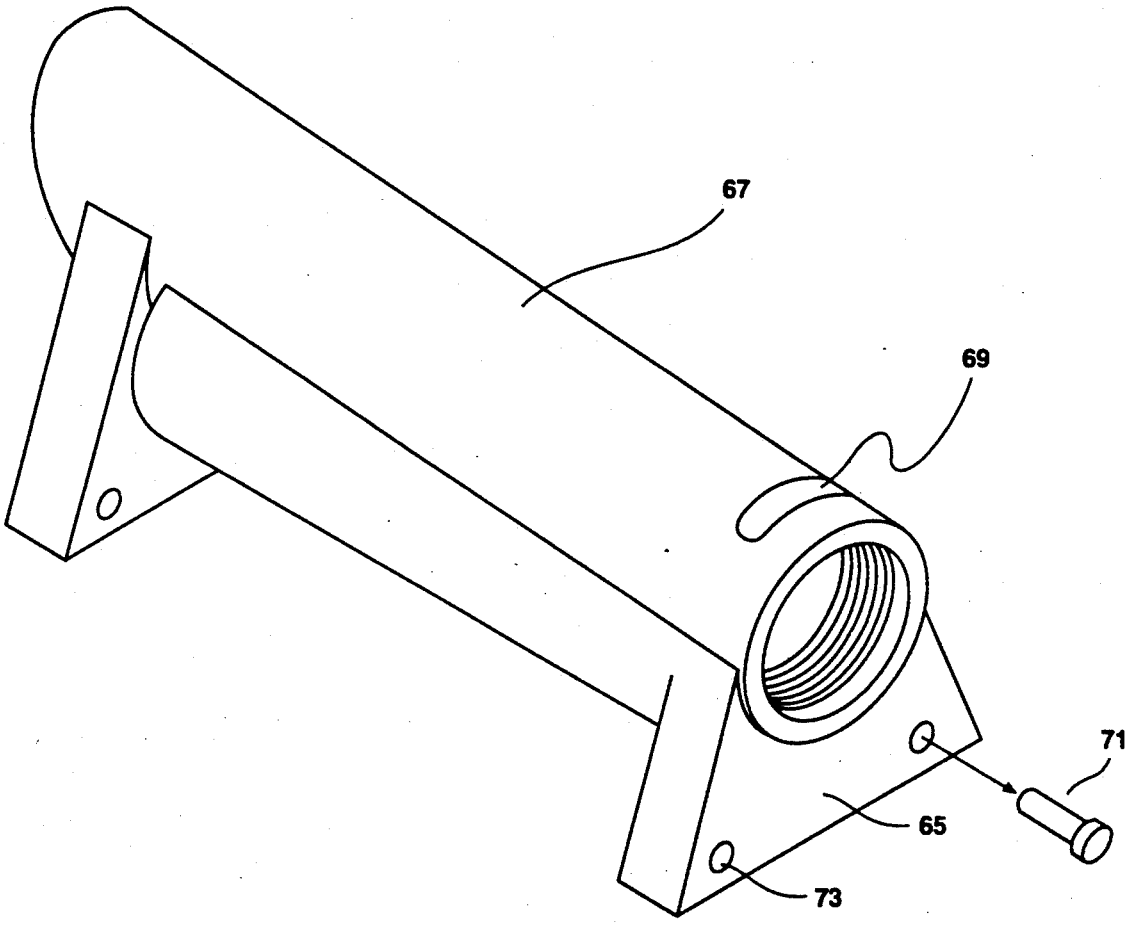
FIG. 5 is a schematic representation of the MRSC (part 2) to be attached to the composite adaptor plate (part 1).

FIG. 5 illustrates the manner in which the composite MRSC 67, with triangular base 65, is attached to the adaptor plate (not shown in FIG. 5, but referenced as 51 in FIG. 4). The two intersecting cylinders, with triangular bases on each end, represents a generic MRSC shape, which could be machined out of a solid block of composite material or could be molded together from separate composite pieces. The triangular base 65 has through-drilled holes 73 by which composite bolts 71 can be used to attach said MRSC 67 to the adaptor plate. Note that the figure further illustrates the presence of a reticle light window 69 on the MRSC 67.

Figure 6:
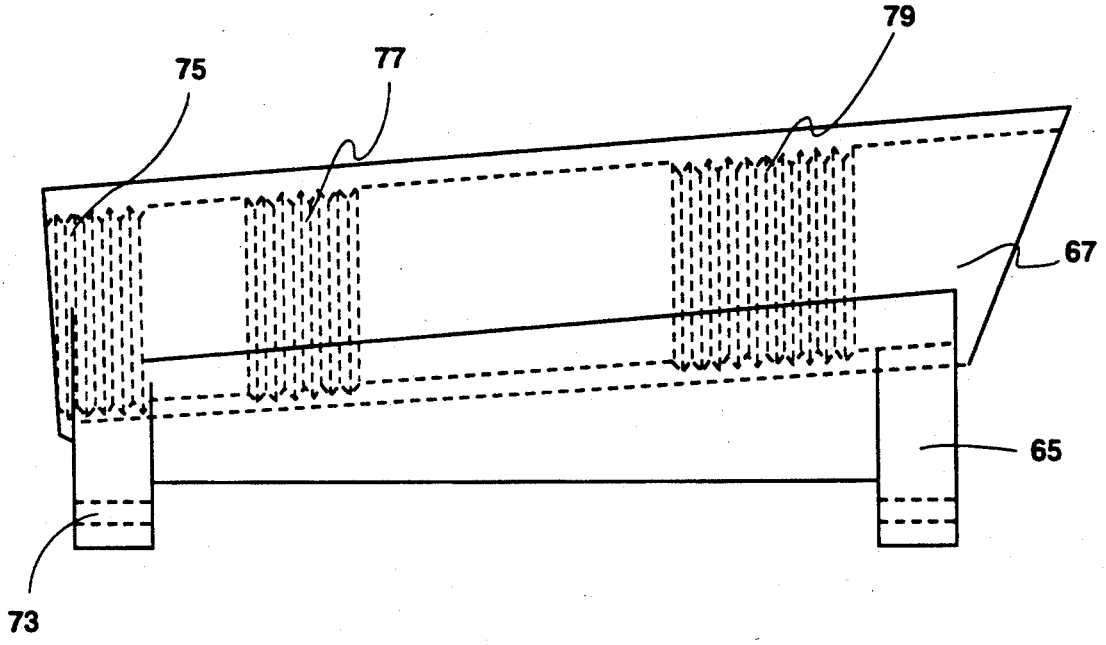
FIG. 6 is a schematic representation of the MRSC (part 2), illustrating the threaded regions cast or machined therein.

FIG. 6 illustrates some of the threaded regions which may be present in the MRSC 67. These threaded regions include a threaded area 75 for a conventional beam splitter and tritium cell unit (not shown here, but referenced in FIG. 3); a threaded area 77 for a conventional reticle cell unit (not shown, but referenced in FIG. 3); a threaded area 79 for a lens cell (not shown here, but referenced in FIG. 3). In addition, the figure depicts the triangular base 65 having threaded holes 73 to facilitate the attaching of the MRSC to the adaptor plate (not shown).

All of the component parts of the MRSC assembly (the MRSC itself and the adaptor plate) are conventional in design. The invention does not reside in any of the individual parts therein. Rather, the invention resides in the combination of these parts wherein said parts are composed of specific materials—i.e. the MRSC and adaptor plate are composed of materials having a low coefficient of thermal expansion and the adaptor is elastically bonded to the existing M1A1 upstand.

The present invention may be employed onto any device of any size. Its use need not be limited to being employed on the M1A1 tank or on the M256 gun barrel. The dimensions of the MRSC assembly employed will be obvious to one having ordinary skill in the art.

While particular embodiments of the present invention have been shown and described, it will be obvious to those skilled in the art that changes and modifications may be made without departing from this invention. Therefore, it is intended that the claims herein are to include all such obvious changes and modifications as fall within the true spirit and scope of this invention.

I claim:

1. A thermally and mechanically stable muzzle reference system collimator assembly comprising a muzzle reference system collimator; and an adaptor plate for affixing said muzzle reference system collimator to a gun barrel;

wherein said muzzle reference system collimator and adaptor plate are composed of materials having a low coefficient of thermal expansion which ranges in magnitude from one-tenth to one-fifth that of steel; and wherein said adaptor plate is attached to the gun barrel through an elastic interface.

2. The muzzle reference system collimator assembly as set forth in claim 1, wherein said material having a low coefficient of thermal expansion is a carbon-carbon fiber matrix.

3. The muzzle reference system collimator assembly as set forth in claim 1, wherein said elastic interface is a silicone adhesive.

4. The muzzle reference system collimator assembly as set forth in claim 3, wherein said solicone adhesive is Dow Corning 3145 RTV adhesive/sealant.

5. A method of minimizing muzzle tracking inaccuracies caused by the uneven heating and thermal expansion of an MRSC upon firing of a gun, wherein a thermally and mechanically stable muzzle reference system collimator assembly is elastically affixed to a gun barrel; said muzzle reference system collimator assembly comprising a muzzle reference system collimator; and an adaptor plate for affixing said muzzle reference system collimator to said gun barrel;

wherein said muzzle reference system collimator and adaptor plate are composed of materials having a low coefficient of thermal expansion which ranges in magnitude from one-tenth to one-fifth that of steel; and wherein said adaptor plate is affixed to the gun barrel through an elastic interface.

* * * * *